US008537051B1

(12) United States Patent
Rudish

(10) Patent No.: US 8,537,051 B1
(45) Date of Patent: Sep. 17, 2013

(54) THREE-DIMENSIONAL IMAGING SYSTEM EMPLOYING FAST-SCANNED ANTENNA ARRAY

(75) Inventor: Ronald M. Rudish, Commack, NY (US)

(73) Assignee: Exelis Inc., McLean, VA (US)

( * ) Notice: Subject to any disclaimer, the term of this patent is extended or adjusted under 35 U.S.C. 154(b) by 285 days.

(21) Appl. No.: 12/913,015

(22) Filed: Oct. 27, 2010

(51) Int. Cl.
*H01Q 3/22* (2006.01)

(52) U.S. Cl.
CPC ..... *H01Q 3/22* (2013.01)
USPC ..... 342/375

(58) Field of Classification Search
CPC ..... H01Q 3/22
USPC ..... 342/368, 375
See application file for complete search history.

(56) References Cited

U.S. PATENT DOCUMENTS

| | | | | | |
|---|---|---|---|---|---|
| 3,618,097 | A | * | 11/1971 | McLeod, Jr. | 342/371 |
| 4,652,879 | A | | 3/1987 | Rudish et al. | |
| 4,749,995 | A | * | 6/1988 | Hopwood et al. | 342/371 |
| 5,179,386 | A | | 1/1993 | Rudish et al. | |
| 5,325,101 | A | | 6/1994 | Rudish et al. | |
| 5,410,320 | A | | 4/1995 | Rudish et al. | |
| 5,430,453 | A | | 7/1995 | Rudish et al. | |
| 5,479,177 | A | | 12/1995 | Rudish et al. | |
| 5,493,306 | A | | 2/1996 | Rudish et al. | |
| 5,523,764 | A | * | 6/1996 | Martinez et al. | 342/372 |
| 5,933,113 | A | * | 8/1999 | Newberg et al. | 342/375 |
| 7,109,918 | B1 | * | 9/2006 | Meadows et al. | 342/368 |
| 7,170,442 | B2 | * | 1/2007 | Lovberg et al. | 342/179 |
| 7,423,607 | B2 | * | 9/2008 | Mohamadi | 343/853 |
| 2009/0027265 | A1 | * | 1/2009 | Zucker | 342/368 |

* cited by examiner

*Primary Examiner* — Gregory C Issing
(74) *Attorney, Agent, or Firm* — Edell, Shapiro & Finnan, LLC

(57) ABSTRACT

A phased array antenna includes an array of antenna elements configured to transmit signals that form an antenna beam. A corresponding set of amplifiers supplies a respective set of continuous wave (CW) signals to the antenna elements for transmission. The CW signals having respective different frequencies that are offset from each other by incremental offset frequencies such that the different frequencies are spaced over a frequency range at intervals. Phases of the set of CW signals are aligned such that, at periodic instants, all of the CW signals have simultaneous zero crossings. The frequency and phase relationships among the set of CW signals cause the antenna elements to radiate an antenna beam that scans a field of view in a raster pattern. The resulting ultra-fast scan rate effectively delivers short pulses to any given point within the field of view, making the radiated signal suitable for three-dimensional imaging.

24 Claims, 7 Drawing Sheets

THREE-DIMENSIONAL IMAGING SYSTEM EMPLOYING FAST-SCANNED ANTENNA ARRAY

BACKGROUND

An active range-gated Millimeter-Wave (MMW) imaging system can yield high resolution three-dimensional images of objects obscured from visual view by smoke, fog, forestry or even non-metallic walls of dwellings and the like. Such a device has many applications in military and homeland defense environments.

The transmit portion of such a system must illuminate each pixel of the scene with high-power to see through the obscurations. Narrow beam widths and short (≦100 picoseconds) pulses are required, respectively, for the high angular and range resolution necessary for imaging. Solid state (i.e., transistor-based) power generation is advisable for small size and high reliability. Narrow beam widths are compatible with small size at MMW frequencies. Unfortunately, currently-available MMW transistors are low power devices (both in terms of average and peak power) that work best when operated in long pulse or continuous wave (CW) modes. Thus, there remains a need for an imaging system that takes advantage of solid state power generation available from MMW transistors while still producing the narrow beam widths and short pulses required for high resolution imaging.

SUMMARY

A phased array antenna includes an array of antenna elements configured to transmit signals that form an antenna beam. A corresponding set of amplifiers supplies a respective set of continuous wave (CW) signals to the antenna elements for transmission. The CW signals having respective different frequencies that are offset from each other by incremental offset frequencies such that the different frequencies are spaced over a frequency range at intervals. Phases of the set of CW signals are aligned such that, at periodic instants, all of the CW signals have simultaneous zero crossings. The duration of a scan of the field of view corresponds to a duration between successive periodic instants at which all of the CW signals have simultaneous zero crossings. The frequency and phase relationships among the set of CW signals cause the antenna elements to radiate an antenna beam that scans a field of view in a raster pattern. The resulting ultra-fast scan rate effectively delivers short pulses to any given point (e.g., a pixel) within the field of view, making the radiated signal suitable for three-dimensional imaging.

The technique employed in the described system avoids the use of phase shifters in generating the scanning beam and, at least at MMW frequencies, allows the use of efficient class E or class F solid state amplifiers, since each antenna element transmits a CW signal at a single frequency (i.e., an extremely narrowband signal that is essentially a pure sine wave). At higher frequencies, class C and D amplifiers can be used, which still provide substantial cost, power, and heat advantages over class A and B amplifiers. Nevertheless, the spectrum of the transmitted signal spans the broader frequency range over which the CW signals are spaced, and effectively produces what appear to be very short pulses within individual pixels in the field of view being evaluated by a receiver system.

The above and still further features and advantages of the present invention will become apparent upon consideration of the following definitions, descriptions and descriptive figures of specific embodiments thereof wherein like reference numerals in the various figures are utilized to designate like components. While these descriptions go into specific details of the invention, it should be understood that variations may and do exist and would be apparent to those skilled in the art based on the descriptions herein.

DETAILED DESCRIPTION

Figure 1:
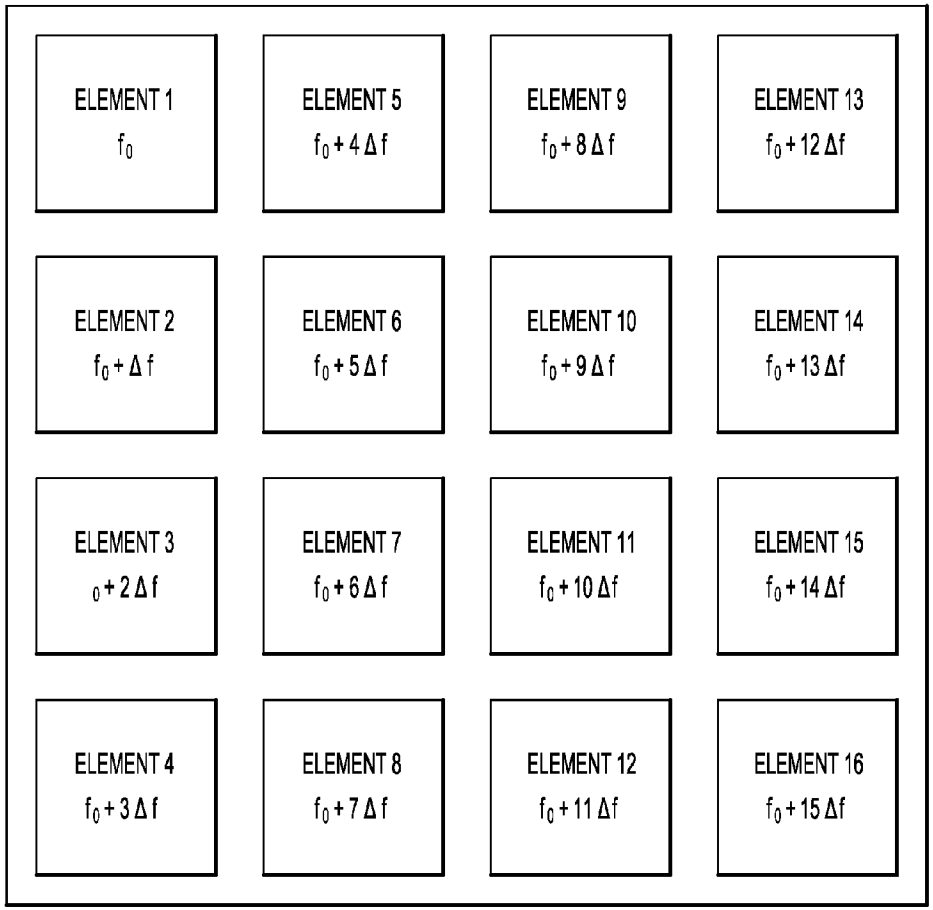
FIG. 1 is a diagram of a rectangular phased array antenna having rows and columns of antenna elements respectively transmitting a set of frequency-offset CW signals.

The active range-gated imaging system described herein can yield high resolution three-dimensional images of objects obscured from visual view by smoke, fog, forestry or even non-metallic walls (dwellings). The system employs an ultra-fast-scanned, active array antenna. The array uses currently available transistors, each operated at only a single frequency, in CW mode, and thus in a high-efficiency mode. When operated together, the elements of the array illuminate a scene with very short pulses at Millimeter-Wave (MMW) frequencies.

The transmit portion the system can illuminate each pixel of the scene with high Effective Radiated Power (ERP) to "see" through the obscurations. The technique effectively achieves the narrow beam widths and short pulses (≦100 picoseconds) necessary for high angular and range resolution, respectively, while still taking advantage of the small size and high reliability of solid state power generation despite the relatively low average and peak power of the MMW transistors employed.

One existing technology to meet similar challenges feeds a pulsed signal to a pre-pulse-compression network that spreads the pulse spectrum so that the pulse can be compressed after its later reception. After spreading its spectrum, the pulse power is divided into many samples and each is fed to a separate linear (class A) power amplifier. The amplifier outputs are fed to combining networks to add the power from the many transistors. After suffering the substantial dissipation losses of these combining networks, the signals are directed to a phased array or multi-beam antenna where the beam-forming or steering introduces additional losses.

Alternatively, an active aperture concept is invoked, that is, the beam-forming or steering is done before final amplification and the combining network is replaced with space combining. Nevertheless, the amplifiers still have to be linear due to the wide spectral content of the signals. Consequently, the poor power efficiency of linear operation creates a massive heat dissipation problem for the final amplifiers, which occupy the tight quarters imposed by array element spacing limitations for avoidance of grating lobes.

Relative to such approaches, the described imaging system yields order-of-magnitude improvements in total power output, pulse narrowing, and prime-power efficiency using currently available transistors for short-pulse generation at MMW and higher frequencies. The vast improvement in efficiency eases the heat dissipation problem that currently limits active MMW transmit array antennas to low power.

The three-dimensional imaging system includes an ultra-fast-scanned phased array, which uses an active aperture concept to avoid combiner and beam-forming or steering losses. In the transmit context, "active aperture" refers to an arrangement in which the final power amplifiers are directly coupled to the array elements (apertures) with essentially no components in between. In other words, the elements/apertures that constitute the array have active elements in them, such that the amplifiers are part of the individual antenna elements/apertures and, in effect, the transmitter is distributed throughout the apertures.

In the described system, each final amplifier is operated in a single-frequency continuous-wave (CW) mode, enabling use of class C and D amplification or even higher efficiency class E/F biasing, depending on the transmit frequency. The system obtains the short pulse on target via an ultra-fast beam scan that illuminates each pixel only for the short period (e.g., 100 picoseconds) that it takes for the beam to pass through it. The ultra-rapid scan is achieved, not with phase shifters, but instead because of coherently related frequency offsets.

In the subject invention, the signal fed to each amplifier/radiator-element chain is offset in frequency from that of its neighbor amplifier/radiator-element chain. For convenience in explaining this frequency plan, assume an array is composed of rows and columns of radiator elements, with the elements being regularly-spaced (e.g., in a rectangular array, the horizontal spacing between adjacent antenna elements remains the same across the array and the vertical spacing between adjacent antenna elements remains the same across the array). Further assume that the radiator elements in the first row (or column) are numbered progressively, and the elements in subsequent rows (or columns) continue that progressive numbering. For example, in the simple four-by-four array shown in FIG. 1, the elements are numbered one to sixteen, with the four elements in the leftmost column being numbered 1-4 from top to bottom, the four elements in the second column from the left being numbered 5-8 from top to bottom and so on.

The drive to element n is a pure sine wave of frequency, $f_0+(n-1)\Delta f$, where $f_0$ is the frequency of the signal to the first element (n=1) and $\Delta f$ is the incremental frequency offset of the frequency of the signal supplied to adjacent neighbors. In the example shown in FIG. 1, the four elements in the leftmost column have the frequencies $f_0$, $f_0+\Delta f$, $f_0+2\Delta f$, and $f_0+3\Delta f$, respectively, from top to bottom. The frequencies of the elements thus progressively increase by the increment $\Delta f$ up to $f_0+15\Delta f$ for the sixteenth element at the bottom of the rightmost column. All of these frequencies can be generated from a single reference by heterodyne or other techniques as described in greater detail herein. Thus, the many drive signals are coherently related in the sense that all their zero crossings occur at precisely the same time (or "line up") once each period of the offset frequency $\Delta f$.

Figure 2:
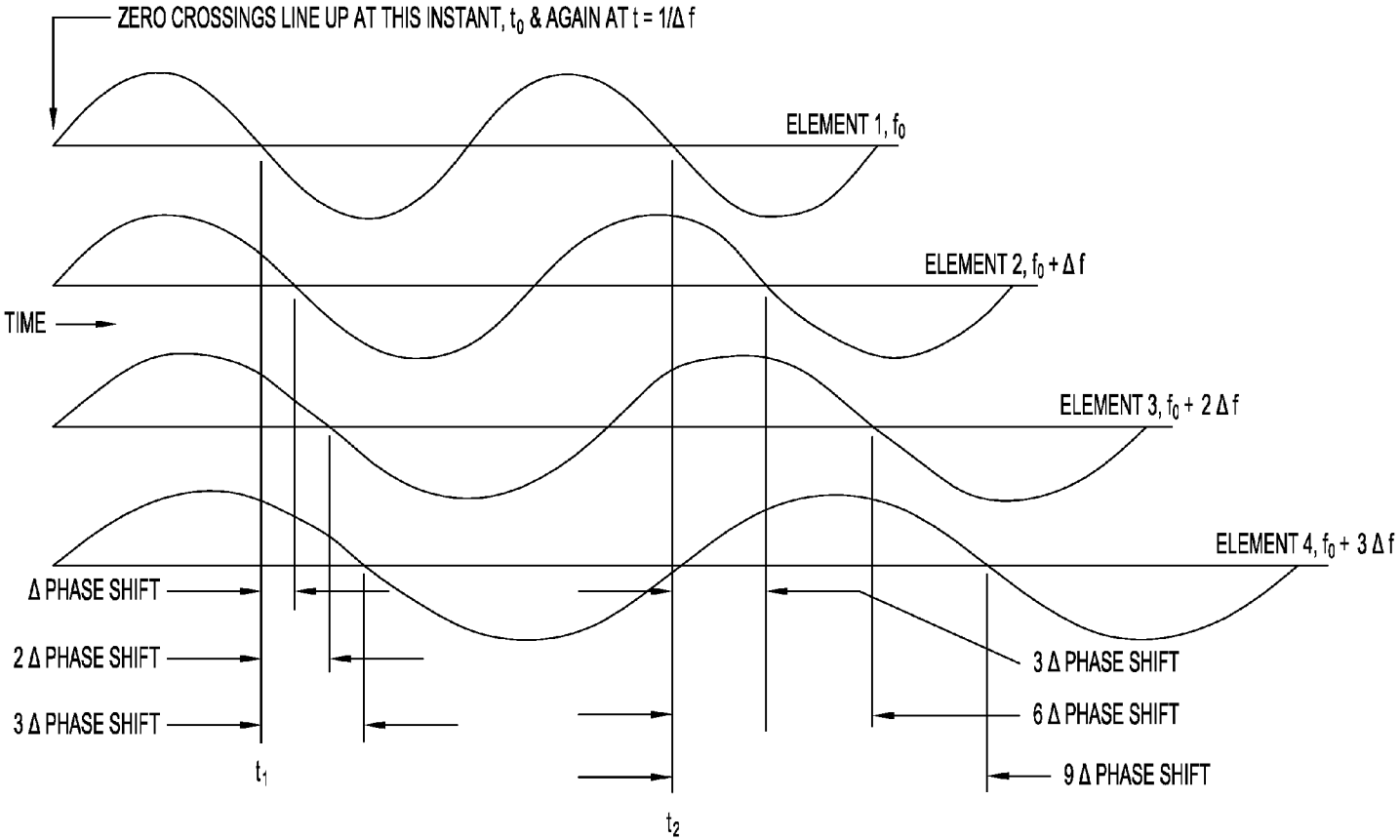
FIG. 2 is a graph showing the frequencies of the radiating CW signals of four antenna elements of a phased array antenna, illustrating the time-varying phase relationship among the signals.

This frequency offset causes the transmitted signal phase to vary linearly with row and column position. FIG. 2 illustrates this concept for the first four frequencies of the four elements of an array (e.g., the elements of the leftmost column of the array shown in FIG. 1). The left edge of the graph depicts a time instant $t_0$ at which the zero-crossings of the four frequencies line up (i.e., the phases of all four signals are zero at this instant). Due to the offset frequencies, the four signals become out of phase in a particular manner as time advances. At some instant in time $t_1$ after $t_0$ (e.g., at the first zero crossing of the signal $f_0$), a phase shift of $\Delta$ radians exists between the first and second signals due to the $\Delta f$ frequency difference between the first and second elements. At that same instant $t_1$, there is a $2\Delta$ phase shift between the first and third signals and a $3\Delta$ phase shift between the first and fourth signals due to the frequency differences between these signals. More generally, the phase shift at time $t_1$ between the first element receiving the frequency $f_0$ and element n in the array is $(n-1)\Delta$. As time progresses further to a later time $t_2$ (e.g., the third zero crossing of the signal $f_0$ after time $t_0$), the phase shifts have increased due to the frequency offsets. Thus, phase shifts of $3\Delta$, $6\Delta$, and $9\Delta$ radians exist between the first signal and the second, third, and fourth signals, respectively, due to the frequency differences. In general, the phase shift at time $t_2$ between the first element receiving the frequency $f_0$ and element n in the array is $3(n-1)\Delta$. As will be appreciated from the foregoing description and FIG. 2, the amount of phase shift from element to element is linearly time-varying. Due to this frequency relationship among the frequencies of the antenna elements, the phases of all of the antenna elements will line up again (i.e., simultaneously have a zero crossing) at time $t=1/\Delta f$ and periodically thereafter ($t=i/\Delta f$, where i is a non-negative integer).

Figure 3:
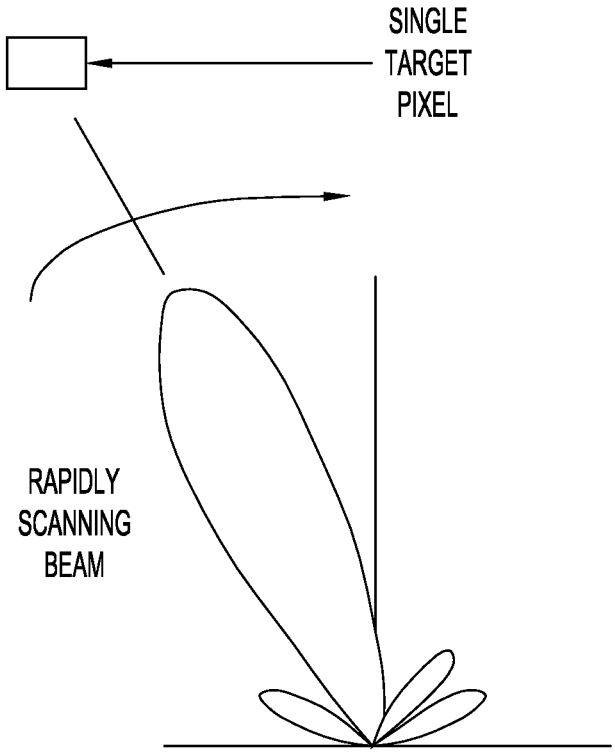
FIG. 3 is a diagram showing a rapidly scanning antenna transmit beam pattern resulting from the time-varying phase shifts which effectively produce a short pulse on each pixel in the field of view.

As shown in FIG. 3, the instantaneous interference pattern created by the relative phases of the elements of the array forms a transmitted beam that scans rapidly in a raster pattern because of this time-varying phase shift. The frequency offsets of the array elements cause time-varying phase shifts that scan the antenna beam main lobe, causing each pixel to be illuminated for a short period of time (effectively a short pulse on the pixel). An individual target pixel is illuminated only during a short beam dwell period resulting from the rapidly scanning beam pattern (the pulse on the pixel has the same shape as the antenna pattern). The dwell period depends at least in part on the array size and the incremental offset frequency $\Delta f$. The scan repeats once every period of the offset frequency $\Delta f$ in accordance with the periodic repetition of the relationship of the phases of the antenna elements. Underlying this mechanism is the concept that each of these separate frequencies has to be coherently related to the others in the special sense that they are all derived from a single frequency and have multiples of a certain difference frequency ($\Delta f$) between them. The set of frequencies are periodically "coherent" in the sense that the set of frequencies is generated such that once every cycle of that difference frequency, all the zero crossings of the set of frequencies line up, resulting in all of the frequencies having a zero phase at that instant. The coherent zero crossing of the frequencies occurs regularly but only once every cycle of the difference frequency $\Delta f$. So, for example, if the difference frequency were one kilohertz, the coherent zero-crossing would occur every $1/1000$ seconds or once every millisecond.

Although each amplifier handles only a single-frequency CW signal, the spectrum of the signal at each target pixel is the multi-line spectral signature that is characteristic of a very short, repetitive pulse. In effect, the array creates a synthetic repetitive pulse by building its spectral content one spectral line at a time (one per amplifier/aperture). Each target pixel experiences the summation of all the signals, so it sees a broadband signal, which corresponds to a very short pulse.

Figure 4:
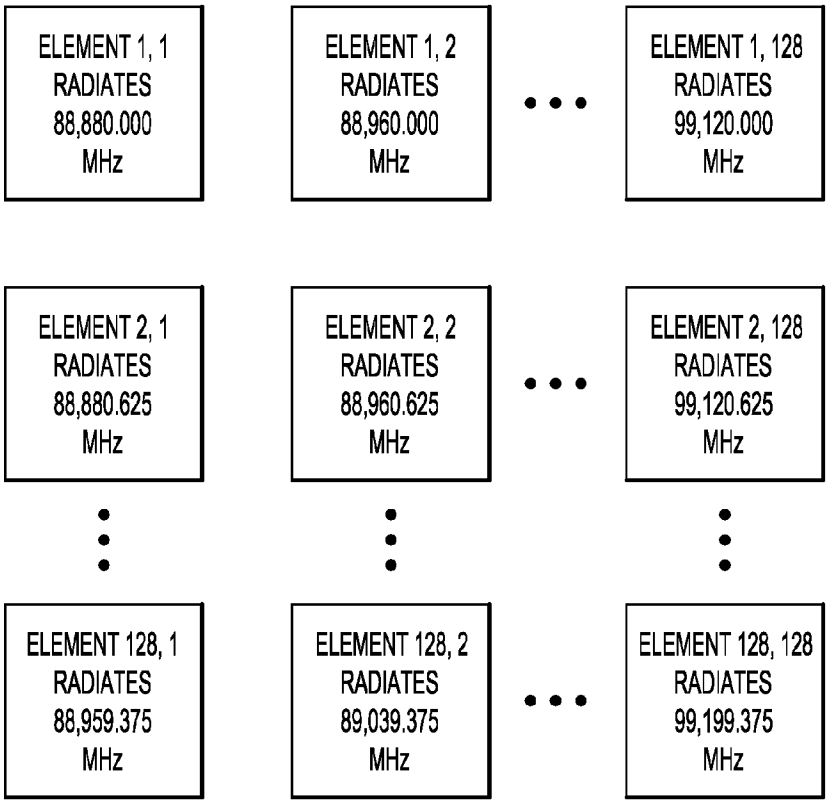
FIG. 4 is a diagram of a rectangular phased array antenna having rows and columns of antenna elements radiating with a specific example set of frequencies.

For purposes of illustration, consider an example based on a regularly-spaced square array containing 128 elements per row and 128 rows and operating at 90-100 GHz, as shown in FIG. 4. Thus, for example, the antenna element in the first (top) row and first (left) column, Element (1,1), radiates at 88,8800.000 MHz. The radiating frequency of antenna Element (2,1) located just below Element (1,1) is offset by 0.625 MHz from frequency of Element (1,1) and thus radiates at 88,880.625 MHz. Proceeding down the first (leftmost) column, each successive element has a radiating frequency greater than the radiating frequency of the element directly above it by 0.625 MHz, such that the last (bottommost) element in the first column, Element (128,1), has a radiating frequency of 88,959.375 MHz. Incrementing of the radiating frequencies continues at the top of the second column, such that the first (topmost) antenna element in the second column from the left, Element (1,2), has a radiating frequency of 88,960.000 MHZ (i.e., 0.625 MHz greater than the radiating frequency of Element (128,1) from the bottom of the previous column). Thus, the first and second elements of the first row (Elements (1,1) and (1,2) are offset by 80 MHz). Like the first column, the second column and each successive column contains elements whose radiating frequencies are incremented from top to bottom by 0.625 MHz between successive elements. Each successive column to the right begins at the topmost element with a radiating frequency that is 0.625 MHz greater than the radiating frequency of the bottommost element of the preceding column to the left. This pattern continues all the way to the bottommost element in the rightmost column, Element (128,128), which has a radiating frequency of 99,199.375 MHz. In each row, the radiating frequencies of adjacent antenna elements are offset by 80 MHz.

In this example, there are 16,384 power amplifiers coupled to a like number of elemental radiators. If each amplifier produces 10 milliwatts of CW power, the total power produced by the array is 160 watts (average and peak). Each element operates at a slightly different CW fixed frequency (all frequencies coherently derived from single source). That allows the operation of each in a highly efficient, class E/F mode of bias in this frequency band. By way of a non-limiting example, each amplifier/radiator cell can be only $\frac{1}{8}^{th}$ inch in width and height so that the square aperture is only 16 inches on each side. Potentially, this can be implemented as 64 monolithic sub-arrays, each 2 inches in both the width and height dimension. At these transmit frequencies, the beam width of such an array is 0.8° for broadside scan (with no aperture taper), yielding quite high angular resolution.

Figure 5:
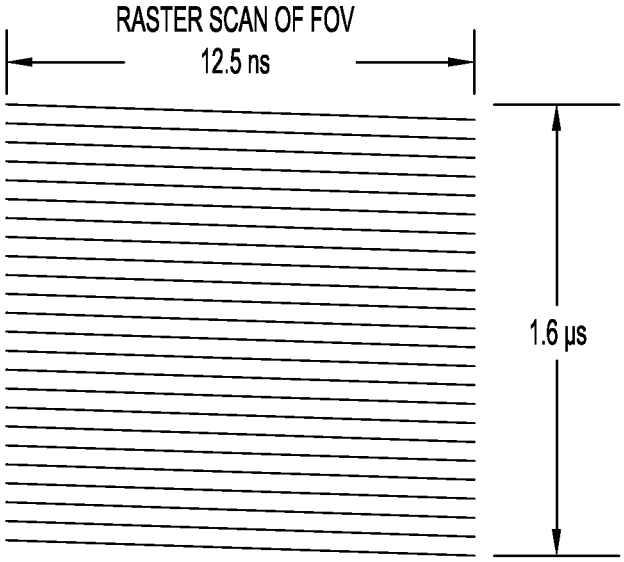
FIG. 5 is a diagram showing a raster scan produced by a phased array antenna employing the principles of the invention.

The frequency differences cause time-varying phase shifts that scan the beam in a raster pattern of the antenna's field of view (FOV), as shown in FIG. 5. In the example shown, the raster pattern begins in the upper leftmost point of the FOV, and scans in the azimuth direction, left-to-right at a slightly downward angle to the right edge of the FOV. The raster pattern continues with a succession of such azimuth scans along parallel, sloped lines, each just below the preceding scan and proceeding downward in elevation. It will be appreciated that no phase shifters are necessary to accomplish this beam scanning; the scanning results from the time-varying phases of the array of CW radiators. The reciprocal of the 80 MHz difference between each adjacent element in each row is also the azimuth scan rate (12.5 ns for full azimuth scan from left to right). The reciprocal of the 0.625 MHz difference between elements in each column is also the elevation scan rate (i.e., frame rate, with 1.6 μs for full elevation from top to bottom). Note that the raster scan can be oriented differently using different orientations of the frequency differences in the array. For example, having 0.625 MHz frequency differences between adjacent elements of the same row and 80 MHz frequency differences between adjacent elements of the same column will result in a raster pattern with a series of top-to-bottom elevation scans that proceed from left to right.

Figure 6:
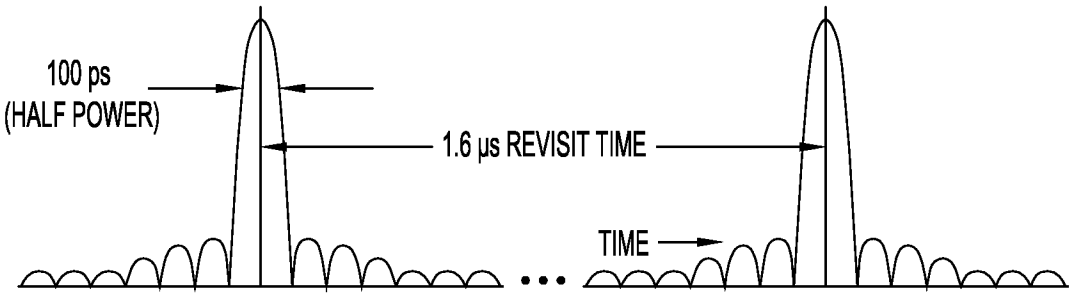
FIG. 6 is a diagram illustrating the effective spectrum and timing of pulses "seen" at a particular pixel within a field of view.

Even though each element radiates only one frequency, the radiated spectrum of the full array consists of 16,384 lines, each spaced 0.625 MHz apart, for a total bandwidth of 10.240 GHz. This is the spectrum of very short, repetitive pulses. The flux on each target pixel resulting from the scan is shown in FIG. 6. Since a full scan of the FOV requires 1.6 μs in this example, the revisit time to any one target pixel in the FOV is 1.6 μs.

In the foregoing example, relative to an antenna element at a constant base frequency $f_0$, other antenna elements are at a constant frequency offset $\Delta f$, and multiples of that constant frequency offset $m\Delta f$. If the spacings of the elements in the array are uniform, then the multiples m of the constant frequency offset $\Delta f$ are integer multiples. If the spacings are not uniform, then the multiples m of the constant frequency offset $\Delta f$ need not be integer multiples. In general, the appropriate offsets necessary for maintaining a substantially constant beam shape and scanning rate can be determined from the specific geometry of the elements in the array. Thus, while the foregoing example involves a regularly-spaced antenna array, the invention is not limited to regularly-spaced arrays, and irregularly-spaced arrays can also be implemented. Unlike a regularly-spaced array in which the incremental offset frequency between antenna elements is constant and the transmit frequencies are spaced over a frequency range at regular intervals, with an irregularly-spaced array, in order to generate the desired beam shape and scan pattern, the incremental offset frequencies vary in accordance with the spacings of the elements and the different frequencies of the antenna elements are, in general, spaced over a frequency range at irregular intervals accordingly.

Figure 7:
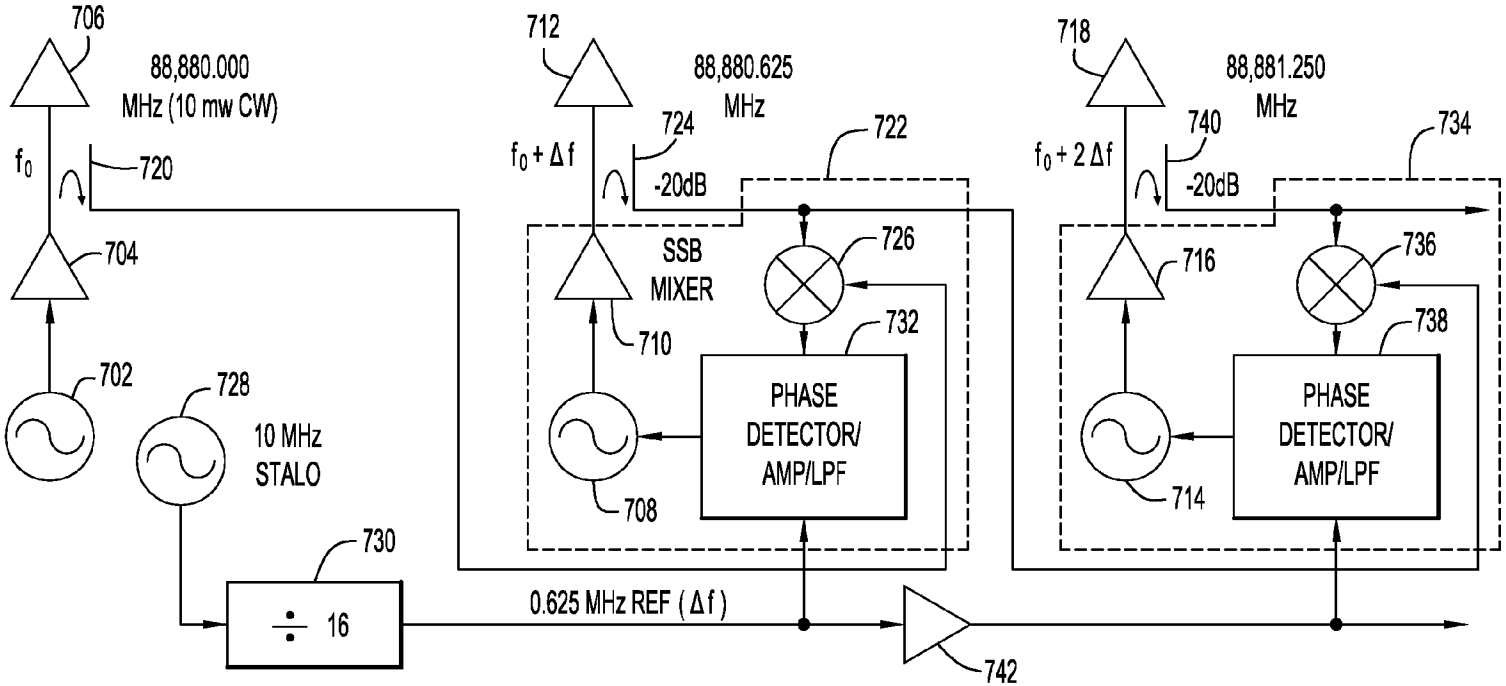
FIG. 7 is a block diagram illustrating one implementation for generating the set of frequencies supplied to the antenna elements of an array to effect ultra-fast scanning.

FIG. 7 illustrates one architecture for implementing this example. The needed coherent set of CW signals can be generated by daisy-chaining multiple phase-locked loops. A first oscillator 702 supplies a first CW signal at the reference frequency $f_0$ (in this example, 88,880.000 MHz) via a first amplifier 704 to a first aperture/radiator 706, which radiates the first CW signal. Likewise, a second oscillator 708 supplies, via an amplifier 710, a second CW signal at the second frequency $f_0+\Delta f$ (in this example, 88,880.625 MHz) that is offset from the reference frequency $f_0$ by the offset frequency $\Delta f$ (in this example, 0.625 MHz) to a second radiator 712, which radiates the second signal. A third oscillator 714 supplies, via a third amplifier 716, a third CW signal at a third frequency $f_0+2\Delta f$ (in this example, 88,881.250 MHz) that is offset from the reference frequency $f_0$ by twice the offset frequency $2\Delta f$, to a third radiator 718, which radiates the third signal. This pattern continues with the remaining antenna elements in the array.

To ensure that the offset frequency $\Delta f$ between the first and second elements is precisely maintained, a first directional coupler 720 between first amplifier 704 and first radiator 706 couples off a small portion (e.g., −20 dB) of the first signal and supplies the coupled-off first signal to a phase-locked loop 710 associated with the second antenna element Likewise, a second directional coupler 724 between second amplifier 710 and second radiator 712 couples off a small portion (e.g., −20 dB) of the second signal and supplies the coupled-off second signal to phase-locked loop 710. Within phase-locked loop 722, a mixer 726 receives the coupled-off first and second signals and combines the signals to generate a difference signal, which is desired to be maintained at the offset frequency Δf.

The output of a 10 MHz stable local oscillator (STALO) 728 is converted to a reference offset signal Δf (e.g., 0.625 MHz) by a divide-by-sixteen circuit 730. The difference signal from mixer 726 and the reference offset signal are supplied to a phase detector 732 of phase-locked loop 722, which compares the two signals and generates an error signal indicating a difference between the reference offset signal and the difference signal. The error signal is supplied to the second oscillator 708, which causes oscillator 708 to correct the frequency and phase of the second signal such that the error signal is brought to zero. Recall that it is not sufficient merely to maintain an accurate frequency offset but that it is also necessary to align in time the zero-crossings of the radiated signals to produce the desired beam shape and to effect scanning. To accurately correct both phase and frequency, phase detector 732 can also include an amplifier that amplifies the phase detector output and supplies the amplified signal to a low pass filter (LPF) whose output is the error signal. The signal loop containing oscillator 708, amplifier 710, mixer 726, and phase detector/amplifier/LPF 732 constitutes the phase-locked loop 722 which maintains the frequency offset between the first and second signals at precisely the frequency Δf of the reference offset signal.

A similar phase-locked loop 734 is provided for the third antenna element, which includes third oscillator 714, third amplifier 716, a mixer 736, and a phase detector/amplifier/LPF 738 arranged in the same manner as the components of phase-locked loop 722. In this case, phase-locked loop 734 compares the coupled-off second signal from the second antenna element with a coupled-off third signal from a third directional coupler 740 located between third amplifier 716 and third radiator 718. By comparing the difference of the second and third signals with the reference offset signal, phase-locked loop 734 maintains the frequency offset between the second and third signals at precisely the frequency Δf of the reference offset signal. While couplers 720, 724, and 740 are shown in FIG. 7 as respectively coupling off the first, second, and third signals after amplification by amplifiers 704, 710, and 716, according to another option, the couplers can be arranged to couple off the first, second, and third signals prior to amplification (i.e., between the oscillators and amplifiers of each antenna element).

While only three antenna elements are shown in FIG. 7 for illustrative purposes, it will be appreciated that the architecture shown extends to all of the antenna elements in the array. One or more amplifiers 742 can be used to amplify the reference offset signal (0.625 MHz in this example) to provide fan out of the signal throughout the array. The resulting signals radiated by the antenna elements in this system possess the special type of coherence required to produce the ultra-fast raster scan, i.e., that all of the signals are in phase (have a simultaneous zero-crossing) once every 1/Δf seconds (the period of the overall raster scan and the revisit time at any given pixel) and have frequencies that are incrementally offset by an offset frequency.

While FIG. 7 depicts the components of the antenna elements as discrete components for purposes of description, it will be appreciated that the components can be integrated and packaged in any suitable manner. For example, multiple components of an antenna element or even multiple antenna elements can be integrated into a single chip. Currently available off-the-shelf PLL chips can be used for offset frequencies below about 1 MHz (e.g., each phase detector/amplifier/LPF can be a single CMOS chip that operates below 1 MHz). At millimeter wave (MMW) or microwave frequencies, custom-designed phase-locked loops may be more suitable.

The implementation shown in FIG. 7 is just one possible approach to generating the set of frequency signals supplied to the antenna elements for producing the ultra-fast scanning beam. Injection locking is another alternative to phase-locked loops. In this implementation, instead of using a phase detector to drive the bias on a varactor or the like, a signal can be injected into the oscillator that pulls its frequency to a desired frequency (injection locking). In effect, the oscillator behaves like an amplifier with feedback. If the feedback is just a bit below the threshold of oscillation, the injection signal will control the frequency and phase of oscillation (the frequency of the injection signal must be fairly close to the natural frequency of the oscillator for injection locking to work properly).

Another approach is based on single-sideband up-conversion of multiple base-band signals generated by direct digital synthesis (DDS). In this implementation, signals corresponding to each of the transmit frequencies are generated by direct digital synthesis, wherein a sine wave is generated from a look-up table, and the digital representation of the signal is supplied to a digital-to-analog (D/A) converter to produce an analog sine wave at a particular frequency that is determined digitally by a clock. For example, the same clock can be used to generate each signal, with a different look-up table for each frequency, thereby yielding the desired phase and frequency relationships among the signals. The signal can be synthesized at lower frequencies with the desired frequency offsets and then up-converted to the transmit frequencies while maintaining the offsets.

Still another approach applies a swept frequency signal to a tapped delay line. The swept frequency signal has a time-varying frequency. For example, the frequency can vary in a saw-tooth pattern from the low end to the high end of the frequency range of the CW signals to be transmitted. A tapped-delay line samples the swept signal at regular or periodic intervals and supplies the sampled signals to respective antenna elements. In effect, the tapped delay line picks off different frequencies at different times such that the resulting frequency signals are offset by a predetermined offset frequency. Since the frequency signals originate from a single source (the swept frequency signal), the frequency offset between signals is reliable and accurate.

Power amplifiers classes relate to the biasing arrangement in the amplifier. When linear amplification is required, a class A or class A/B amplifier is typically used. Due to minimal harmonic distortions, class A and class A/B amplifiers are suitable where broadband coverage or multiple frequencies are required. The downside to these amplifiers is poor efficiency. Substantial prime power must be supplied, and considerable energy and heat are lost during operation. Class C and D amplifiers are more narrow band and are non-linear in operation, and tuning filters or the like are used to reject harmonics and harmonic distortion caused by the non-linear operation. Class E and F amplifiers provide highly efficient operation and are capable of high speed on-off switching and are very non-linear in that the switching transistor essentially alternates between an off state and a saturated state, producing a square wave that can be filtered to retrieve the fundamental frequency.

A significant advantage of the fast-scanned antenna array described herein is that the design of the system permits use of switched-mode (class E/F) amplifiers, at least at MMW frequencies. At MMW frequencies and lower (e.g., X-band, gigahertz frequencies), very high cutoff frequency transistors can turn on and off very rapidly. If the application center frequency is higher than that for which switched mode operation has been demonstrated (e.g., 80 or 90 GHz), then class C or D operation can be used. These classes of operation, made possible by the single frequency character of each signal, would still provide substantial efficiency benefit compared to the class A operation required by prior technology, which must amplify the entire short pulse spectral content. Nevertheless, the described system is capable of generating the wide bandwidth of the very short pulses necessary for imaging applications.

The transmit array of the described herein can be part of an active radar imaging system. Thus, it is to be used with a separate, multi-beam receiving antenna. This receiving antenna provides multiple fixed beams, one for each pixel of the field of view (FOV), i.e., each receive beam is along a different beam direction that corresponds to a pixel. A time-gated receiver at each beam port is synchronized to the transmit frame start, with a delay appropriate for the beam position and the desired group of range cells. A Schmidt-corrected spherical reflector coupled to a focal plane array is one candidate for the receive antenna. Thus, a plurality of receivers respectively correspond to the plurality of beam directions (pixels) and detect the reflected signals received by the multi-beam receiving antenna along the plurality of beam directions to provide imaging information on a pixel-by-pixel basis.

While described in the context of a two-dimensional planar phased array antenna, the invention is not limited to planar arrays and can be implemented in arrays that are not strictly planar. Likewise, the invention has been described in the context of a phased array antenna in which the antenna elements are arranged in a rectangular grid. However, the concept can also be employed in other types of antenna arrangements such as phase array antennas in which the antenna elements are arranged in a triangular grid (e.g., where each interior antenna element has six neighboring elements arranged in a hexagon around the antenna element). Further, the array can have tapered power for beamshaping and reducing side lobes, wherein the elements radiate different levels of power across the array.

Having described preferred embodiments of a fast-scanned antenna array and three-dimensional imaging system, it is believed that other modifications, variations and changes will be suggested to those skilled in the art in view of the teachings set forth herein. It is therefore to be understood that all such variations, modifications and changes are believed to fall within the scope of the present invention as defined by the appended claims. Although specific terms are employed herein, they are used in a generic and descriptive sense only and not for purposes of limitation.

What is claimed is:

1. A phased array antenna, comprising:

a plurality of antenna elements arranged in a two-dimensional array of a size and antenna element spacing corresponding to a particular scan rate of an antenna beam;

a plurality of amplifiers coupled to the respective antenna elements;

a plurality of oscillators coupled to the respective amplifiers to generate respective continuous wave (CW) signals having respective different frequencies that are spaced over a frequency range at intervals corresponding to an fixed offset frequency such that phases of the CW signals align at zero phase with periodicity corresponding to no less than the scan rate of the antenna beam; and wherein the amplifiers supply the respective antenna elements the CW signals in a spatial distribution thereof that compels the antenna elements to radiate the antenna beam to scan a field of view in a raster pattern at the scan rate.

2. The phased array antenna of claim 1, wherein the antenna elements are arranged in a regularly-spaced array and the different frequencies are spaced over the frequency range at regular intervals.

3. The phased array antenna of claim 1, wherein the antenna elements are arranged in a rectangular array and the amplifiers are configured to supply the CW signals to the antenna elements such that the frequencies of the CW signals are incremented from antenna element to antenna element along rows and columns of the array.

4. The phased array antenna of claim 1, wherein the amplifiers are class E or class F solid state amplifiers.

5. The phased array antenna of claim 1, wherein the amplifiers are class C or class D solid state amplifiers.

6. The phased array antenna of claim 1, wherein a scan rate of the antenna beam results in the antenna beam dwelling on a point in the field of view for no more than 100 picoseconds.

7. The phased array antenna of claim 1, wherein a spectrum of the antenna beam spans the frequency range over which the CW signals are spaced.

8. The phased array antenna of claim 1, wherein scanning of the antenna beam is achieved without use of phase shifters.

9. A three dimensional imaging system, comprising:

the phased array antenna of claim 1;

a multi-beam receiving antenna configured to separately receive reflected signals along a plurality of beam directions within the field of view, the beam directions corresponding to pixels; and a plurality of receivers respectively corresponding to the plurality of beam directions and configured to detect the reflected signals received by the multi-beam receiving antenna along the plurality of beam directions to provide imaging information on a pixel-by-pixel basis.

10. A method of operating a phased array antenna, comprising:

generating, via a plurality of oscillators, a set of continuous wave (CW) signals having respective different frequencies that are spaced over a frequency range at intervals corresponding to a fixed offset frequency such that phases of the set of CW signals align at zero phase with periodicity corresponding to no less than a scan rate of an antenna beam; and supplying the set of CW signals to a respective plurality of antenna elements in a spatial distribution thereof that compels the antenna beam to scan a field of view in a raster pattern at the scan rate; and transmitting the CW signals in accordance with the spatial distribution from the antenna elements.

11. The method of claim 10, wherein the antenna elements are arranged in a regularly-spaced array, and generating the set of CW signals includes offsetting the different frequencies such that the different frequencies are spaced over the frequency range at regular intervals.

12. The method of claim 10, wherein supplying the set of CW signals comprises supplying the set of CW signals to antenna elements arranged in a rectangular array such that the frequencies of the CW signals are incremented from antenna element to antenna element along rows and columns of the array.

13. The method of claim 10, wherein generating the set of CW signals comprises generating the set of CW signals with amplifiers that are class E or class F solid state amplifiers.

14. The method of claim 10, wherein generating the set of CW signals comprises generating the set of CW signals with amplifiers that are class C or class D solid state amplifiers.

15. The method of claim 10, wherein a scan rate of the antenna beam results in the antenna beam dwelling on a point in the field of view for no more than 100 picoseconds.

16. The method of claim 10, wherein a spectrum of the antenna beam spans the frequency range over which the CW signals are spaced.

17. The method of claim 10, wherein scanning of the antenna beam is achieved without use of phase shifters.

18. A method of performing three-dimensional imaging over a field of view, comprising:

transmitting an antenna beam that scans a field of view according to the method of claim 10; and detecting signals reflected by objects within the field of view via a separate receive antenna of a receiver system, wherein the receiver system evaluates the field of field view on a pixel-by-pixel basis, such that reflected signals correspond to signal pulses within individual pixels.

19. A method of manufacturing a phased array antenna, comprising:

arranging a plurality of antenna elements in an array; and respectively coupling a plurality of amplifiers to the antenna elements; and respectively coupling a plurality of oscillators to the respective amplifiers, the oscillators supplying a respective set of continuous wave (CW) signals to the amplifiers for transmission by the antenna elements, the CW signals having respective different frequencies that spaced over a frequency range at intervals corresponding to a fixed offset frequency such that phases of the set of CW signals align at zero phase with periodicity corresponding to a scan rate of an antenna beam, the set of CW signals being spatially distributed across the array by the respective oscillators therein that compels the antenna elements to radiate the antenna beam to scan a field of view in a raster pattern at the scan rate.

20. The method of claim 19, wherein the antenna elements are arranged in a rectangular array and the amplifiers are configured to supply the CW signals to the antenna elements such that the frequencies of the CW signals are incremented from antenna element to antenna element along rows and columns of the array.

21. The method of claim 19, wherein the amplifiers are class E or class F solid state amplifiers.

22. The method of claim 19, further comprising:

providing a separate receive antenna for receiving signals reflected by objects within the field of view.

23. The phased array antenna of claim 1, wherein the oscillators each generate a constant frequency CW signal that is fixed to the corresponding one of the different frequencies.

24. The phase array antenna of claim 23, wherein the oscillators are phase-locked to the offset frequency to generate the constant CW signal.

* * * * *